United States Patent [19]

Kaufmann

[11] Patent Number: 4,487,516

[45] Date of Patent: Dec. 11, 1984

[54] PRINTING NEEDLE APPARATUS

[76] Inventor: Rainer Kaufmann, Witts-Allee 32, D-2000 Hamburg 55, Fed. Rep. of Germany

[21] Appl. No.: 469,157

[22] Filed: Feb. 24, 1983

[30] Foreign Application Priority Data

Feb. 27, 1982 [DE] Fed. Rep. of Germany ..... 3207195

[51] Int. Cl.[3] ..... B41J 3/12

[52] U.S. Cl. ..... 400/124; 101/93.05; 310/328

[58] Field of Search ..... 400/124; 101/93.05; 310/328

[56] References Cited

U.S. PATENT DOCUMENTS

| | | | |
|---|---|---|---|
| 3,715,020 | 2/1973 | Nordin | 400/124 |
| 4,174,182 | 11/1979 | Lendl | 400/124 |
| 4,230,411 | 10/1980 | Grottrup | 400/124 X |
| 4,293,232 | 10/1981 | Linder | 400/124 |

*Primary Examiner*—Paul T. Sewell

*Attorney, Agent, or Firm*—James E. Nilles

[57] ABSTRACT

In needle printing apparatus with a plurality of parallel working printing needles which are each provided with a selectively controllable blocking device and a yielding stroke equalizing element, in order to arrive at an extraordinarily compact construction each printing needle and its stroke equalizing element is formed in one elongated piece of springy material. Preferably all of the printing needles and their stroke equalizing devices are made from one suitable spring plate, formed by etching, stamping, milling or the like, in the shape of a comb whereof each tooth comprises an actual printing needle, and the stroke equalizing element has a zigzag shape. The printing needle and the yielding equalizing element are thus no thicker than the thickness of the spring plate. Over this thin spring plate one can then arrange corresponding blocking elements, likewise formed in comb shape. Each individual tooth of this blocking element comb is formed as a piezoelectric bending transducer which can freely engage between the printing needles and on which there is an abutment that engages an abutment on the shaft of the respective printing needle to arrest the latter against forward motion.

7 Claims, 8 Drawing Figures

PRINTING NEEDLE APPARATUS

The invention relates to a printing needle apparatus comprising a plurality of printing needles that operate substantially in parallel and are actuatable lengthwise by means of a suitable back and forth moving actuator, for engagement of their tips against a recording medium. In such apparatus, actuating force is applied to each printing needle through a yielding stroke equalizing element, and for each needle there is a selectively controllable blocking device which operates to hold the front end of the needle stationary so that it does not engage the recording medium.

In printing needle technology heretofore known there is difficulty in increasing the printing speed by increasing the number of printing needles that work in parallel, since very much space is taken up on the one hand by the stroke equalizing spring devices and on the other hand by the known control or blocking elements. By reason of this undesirably high space requirement, the individual printing needles—and in a multiple-row device, the individual printing needle rows—cannot be arranged as close to one another as would be desirable.

The object of the present invention is to provide an improved printing needle apparatus of the type just described, wherein the individual printing needles can be arranged substantially more closely beside one another and wherein the yielding stroke equalizing elements do not project out beyond the plane of the side-by-side printing needles of a printing line.

The problem presented is solved according to the invention in that the yielding stroke equalizing elements are a permanent component of printing needles which are formed of resilient material and which, in their rear portions, are of zigzag or wave-shaped form in the plane of the printing line.

Further features of the invention will be apparent as the description proceeds.

In the following, preferred embodiments of the invention are described with reference to the accompanying drawings.

Figure 1:
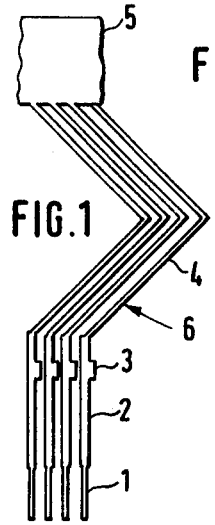
FIG. 1 is an enlarged section of a printing needle comb in plan view.

In printing needle apparatus of the present invention, a plurality of individual needles 2 are spaced apart at regular intervals, lengthwise parallel to one another and lying in a common plane, so that their tips 1 can impress a row of dots upon a recording medium as the needles are moved lengthwise into engagement with it. The printing needles 2 are thus arranged like the teeth of a comb, and the assembly 6 comprising one row of printing needles is sometimes referred to herein as a printing needle comb. In the printing needle comb of the present invention, each stroke equalizing element 4 is formed in one piece with its needle shaft 2.

Figure 2:
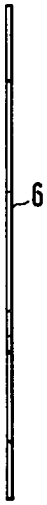
FIG. 2 is a side view of FIG. 1.

A section of printing needle comb according to the invention, illustrated in FIGS. 1 and 2 at a scale of about 2:1, can be etched, stamped or manufactured by any of several controlled cutting processes from a springy metal sheet corresponding to the desired thickness of the dots to be printed. The tip 1 of each needle has approximately the width of the metal thickness, so that a square printed dot results. The needle shaft 2 has a sidewardly projecting lug 3 which cooperates with an abutment 8, described hereinafter, to arrest the needle against movement into contact with the recording medium. The yielding equalizing element 4 is so formed, depending upon the spacing between needles and the printing stroke, that upon arresting of one needle and resultant pressing together of the yielding equalizing elements 4, the neighboring needles are not hindered in the printing process. The cross bar 5, with which all of the printing needles of the row are formed in one piece, holds the printing needles together and at the same time serves as a printing beam that is connected with a conventional eccentric drive or the like (not shown) to be movable up and down.

The advantages of this printing needle configuration lie in the very low manufacturing cost, in the extraordinarily compact arrangement, and in the avoidance of interference, so that the printing needles in a multiple row arrangement can cover a surface without overlapping, owing to their square tips.

Figure 3:
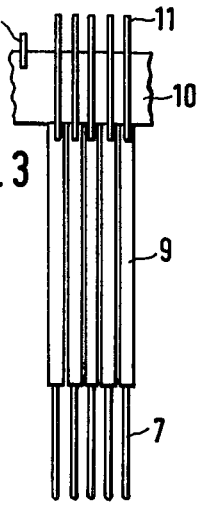
FIG. 3 is an enlarged section of a blocking elements comb in plan view.
Figure 4:
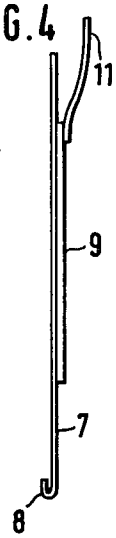
FIG. 4 is a side view of FIG. 3.

In FIGS. 3 and 4 there is illustrated on a scale of about 2:1 a section of a blocking element comb comprising a plurality of piezo bending transducers and which in combination with the printing needle comb 6 (FIGS. 1 and 2) can prevent each individual printing needle, under electronic control, from engagement against the recording medium.

The basic material of the blocking element comb is springy sheet metal, and upon the middle region of each of its teeth there is cemented a piezo stratum 9. The outer end of each comb tip 7 is bent through 180° to form, in each case, a hook-like lock 8 for an adjacent printing needle, engageable with the lug 3 thereon. The width of the hook-like tips 7 is such that they can swing between the printing needle shafts 2. A cross bar 10 of the blocking element comb holds the individual blocking elements together and is fastened to a stationary base 13. Through an electrical connection 11 on each piezo blocking element, a voltage potential can be conducted to the individual blocking element, to bring about a bending of it that engages its hook-like tip 7 with the cooperating lug 3. The conduction of the electrical null potential is accomplished through a suitable connection 12 to the cross bar 10.

Figure 5:
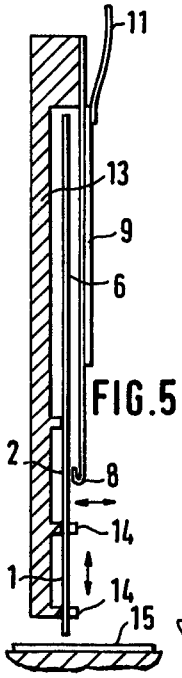
FIG. 5 is an illustration of the combination of printing needle comb and blocking element comb in sectional side view.

FIG. 5 shows the general construction of the combination of printing needle comb and blocking element comb in sectionalized side view. The needle tips 1 of the printing needle comb move up and down in guides 14. The blocking elements can thus be selectively swung between the needle shafts 2, and with their abutments 8, which engage against the lug 3, can prevent a downward movement of the needle shafts 2 and needle tips 1. As the needle comb is actuated downward, the yielding equalizing elements 4 of the working printing needles maintain their form according to FIG. 1, but those of the arrested printing needles are deformed to be more acute-angled. Since the needle tips 1 are guided, an embodiment that is very advantageous from the standpoint of production is possible, wherein the yielding stroke equalizing elements 4, which all lie in the plane of the needle shafts 2, extend only to one side of their respective needle shafts, and each has a right-angled apex, to have a half-wave configuration.

A base plate 13 that holds the blocking element comb, which is connected with the drive and guides the printing needle comb, stands at a fixed distance from the printing support 15 upon which the recording medium rests.

Figure 7:
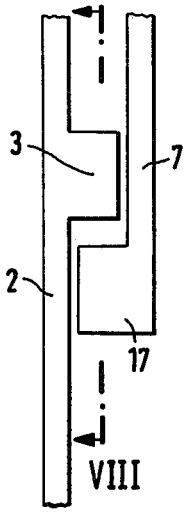
FIG. 7 is a schematic much enlarged plan view of a pair of blocking elements.
Figure 8:
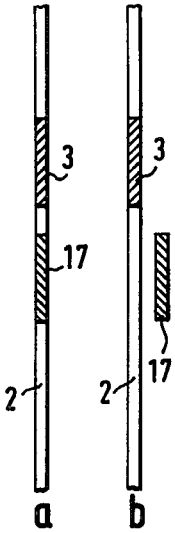
FIG. 8 is a section taken on the section line VIII—VIII of FIG. 7, shown in the blocked (a) and unblocked (b) condition.

FIGS. 7 and 8 show a unit comprising a needle lug 3 and a blocking element 7, the abutment 17 of which projects sidewardly and not in this case forwardly. In this case, therefore, the hook-like bending over of the tip of the blocking element, as in FIG. 4, is unnecessary. FIG. 8*a* shows the conditions when the piezo bending transducer is blocking, and FIG. 8*b* shows the released condition. Instead of a sideward lug 3, there could obviously be provided a cutout in the needle shaft 2 into which an abutment could fall.

Figure 6:
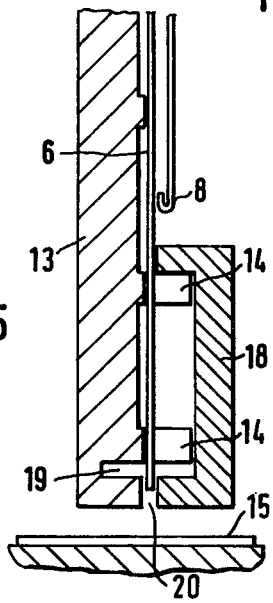
FIG. 6 is the lower guide for the printing needles on a still larger scale.

FIG. 6 shows in side view the configuration of the needle guides. The guide bars 14 are provided with grooves that correspond to the needle width and the needle distance, and the needles are confined in them by means of the cover plate 18, to be thus guided in all transverse directions. The cover plate 18 thus substantially facilitates assembly and eliminates the simultaneous insertion of a plurality of needle tips into respective bores.

The recess 19 under the lower guide bar 14 and the cover 18 can be filled with ink, which then also enters into the needle exit slit 20 but cannot run out of it because of capillary force. In this manner needle points that are wetted with ink can produce printed dots on the print medium.

The previously employed expression "springy sheet metal" is not intended to be limited to steel sheet with resilient properties but includes sheets of other suitable resilient metals.

As the testing of the subject matter of the application has shown, the needle printing apparatus according to the invention operates with extraordinary reliability and accuracy, which is achieved because the arresting of the printing needle in a non-printing position is effected in every case by a form-related cooperation of abutments on the printing needles and on the piezoelectric bending oscillators.

The heretofore employed arresting devices for needle printing apparatus that operate by force blocking have the disadvantage, known from experience, that dirt can cause them to block in non-braking conditions or can result in the application of a braking force of insufficient magnitude so that the printing needles slide through and are not held back.

What is claimed as the invention is:

1. Needle printing apparatus comprising a row of printing needles that have respective axes which are parallel to one another and are all contained substantially in a single plane, each said needle having a tip at a front end thereof and being movable lengthwise forwardly from a normal position in response to a forward force upon it, for engagement of its tip against a recording medium, a yielding stroke equalizing element for each printing needle through which forward force is applied to it and whereby confinement of the needle against forward motion is prevented from interfering wiht the application of forward force to the other needles, and a controllable blocking device for each needle, normally in a relaeasing condition permitting lengthwise forward movement of the needle but energizable to a blocking condition confining the needle against forward motion in response to said force, said needle printing apparatus being characterized by:

A. each printing needle and its stroke equalizing element comprising a single elongated piece of resilient material; and B. each stroke equalizing element (1) being behind its needle, (2) being substantially wholly contained in said plane, and (3) comprising a pair of elongated portions of said one piece which project obliquely forwardly at opposite inclinations to the axis of the printing needle and which are connected with one another at a substantially sharp-angled junction to have a substantially zigzag form.

2. The needle printing apparatus of claim 1 wherein all of said printing needles nad their respective stroke equalizing elements are formed from a single piece of resilient material and are connected by an integral bar-like portion upon which forward force can be exerted to be applied to all of said needles simultaneously.

3. The needle printing apparatus of claim 1 wherein each stroke equalizing element projects only to one side of the axis of its printing needle

4. The needle printing apparatus of claim 1, further characterized by:

C. said blocking device for each printing needle comprising a piezoelectric bending transducer having an abutment element which is spaced from said plane in the releasing condition of the blocking device and which is carried towards said plane upon energization of the transducer; and D. each printing needle having thereon an abutment which is engaged by the abutment element on its blocking device in the energized condition of the latter.

5. The needle printing apparatus of claim 4, further characterized by:

E. each blocking device further comprising an elongated resilient element which the piezoelectric bending transducer lengthwise overlies and to which it is bonded, said resilient element being formed in one piece with a bar that extends across a rear end thereof and from which the resilient elements of the several blocking devices project forwardly like the teeth of a comb.

6. The needle printing apparatus of claim 1, further characterized by:

C. needle guide means having a plurality of laterally opening grooves in which the tip portions of said needles are respectively received, and D. a cover plate secured to said needle guide means to close said grooves and cooperate with them in confining the tip portions of the needles to lengthwise sliding motion.

7. The needle printing apparatus of claim 6, further characterized by:

said needle guide means and said cover cooperating to define an ink chamber that extends across all of the printing needles of said row and from which each needle can carry along ink on its tip during its forward movement.

* * * * *